United States Patent [19]

Fattori et al.

[11] Patent Number: 4,840,511

[45] Date of Patent: Jun. 20, 1989

[54] ELONGATED ROLL-ON APPLICATOR PACKAGE WITH RESILIENT LINER

[75] Inventors: Joseph E. Fattori, Mendham; Siegbert O. Wagner, Basking Ridge, both of N.J.

[73] Assignee: The Mennen Company, Morristown, N.J.

[21] Appl. No.: 84,403

[22] Filed: Aug. 10, 1987

[51] Int. Cl.[4] ..... A45D 34/04

[52] U.S. Cl. ..... 401/213; 401/208

[58] Field of Search ..... 401/208, 213, 219, 220

[56] References Cited

U.S. PATENT DOCUMENTS

| | | | |
|---|---|---|---|
| Re. 25,380 | 5/1963 | Ackerman | 15/572 |
| 449,233 | 3/1891 | Porter . | |
| 2,749,566 | 5/1956 | Thomas | 15/132.7 |
| 2,892,202 | 6/1959 | Williams | 15/132.5 |
| 2,910,712 | 11/1959 | Schaich et al. | 401/213 |
| 2,997,731 | 8/1961 | Schultz | 15/572 |
| 2,998,616 | 9/1961 | Gentile | 15/572 |
| 3,036,328 | 5/1962 | Schaich | 15/572 |
| 3,090,987 | 5/1963 | Ruekberg | 15/572 |
| 3,134,131 | 5/1964 | Thomas | 15/571 |
| 3,259,935 | 7/1966 | Miller | 15/571 |
| 4,002,411 | 1/1977 | Harbauer | 401/213 |
| 4,021,125 | 5/1977 | Berghahn et al. | 401/213 |
| 4,030,844 | 6/1977 | Lench et al. | 401/213 |
| 4,129,391 | 12/1978 | Gamacher | 401/208 |
| 4,164,377 | 8/1979 | Lohrman et al. | 401/213 |
| 4,168,128 | 9/1979 | Fillmore et al. | 401/213 |
| 4,386,179 | 5/1983 | Sterling | 524/269 |
| 4,475,837 | 10/1984 | Dornbusch et al. | 401/213 |

FOREIGN PATENT DOCUMENTS

| | | | |
|---|---|---|---|
| 1207708 | 7/1986 | Canada | 401/213 |
| 434909 | 5/1948 | Italy | 401/208 |

OTHER PUBLICATIONS

Mennen Company Roll-on Package from Early 1960's.

*Primary Examiner*—Steven A. Bratlie

*Attorney, Agent, or Firm*—Davis Hoxie Faithfull & Hapgood

[57] ABSTRACT

The invention comprises a roll-on applicator package having a container for storing a fluid such as a perfume or lotion or an antiperspirant or deodorant composition, an elongated roller supported on stub axles near the container top for dispensing the fluid and a resilient cap having attached therein a resilient liner for sealing the container. The resilient liner is preferably an elastomeric material and has a Durometer measurement of 20–35 Shore A.

7 Claims, 3 Drawing Sheets

ELONGATED ROLL-ON APPLICATOR PACKAGE WITH RESILIENT LINER

BACKGROUND OF THE INVENTION

1. Field of the Invention

The invention relates to applicators for fluids, such as perfumes, lotions and antiperspirant and deodorant compositions. More particularly, the invention relates to roll-on applicators providing larger surfaces of application as compared to conventional ball roll-ons.

2. Description of the Prior Art

Prior art devices include ball roll-on dispensers. Ball roll-ons are well known in the cosmetics art for dispensing fluids such as deodorants, lotions, perfumes and the like. However, such devices provide only a point of contact with the surface to which the cosmetic is applied.

Furthermore, ball roll-ons are sometimes hindered in their rotation due to the manner in which the ball is retained in place at the top of the container.

Conventional roll-on packages are often sealed by driving the ball downward against the neck area of the container when the cap is applied. This tends to seal the volume below the neck of the container but can allow the product remaining on top of the ball, above the seal, to dry out between uses. This leads to difficulty of application in subsequent use.

SUMMARY OF THE INVENTION

The present invention relates to applicators for fluid cosmetic preparations, such as lotions and perfumes, and more particularly for antiperspirant and deodorant compositions. The present invention comprises a roll-on applicator package having a container for storing a fluid to be dispensed, an elongated roller having axle stubs to support the roller, atop the storage container, and a resilient cap which contains a resilient liner for sealing the package.

It is an object of the invention to provide a larger surface of application than that of a ball roll-on package.

It is a further object of the invention to provide improved rolling characteristics over those of prior art roll-on packages.

It is another object of the invention to provide improved sealing conditions for preventing the product from drying out between uses.

It is another object of the invention to provide excellent sealing means to prevent product leakage when the cap is secured in place on the container in the event the container is shaken or is lain on its side.

DESCRIPTION OF THE PREFERRED EMBODIMENTS

Figure 1:
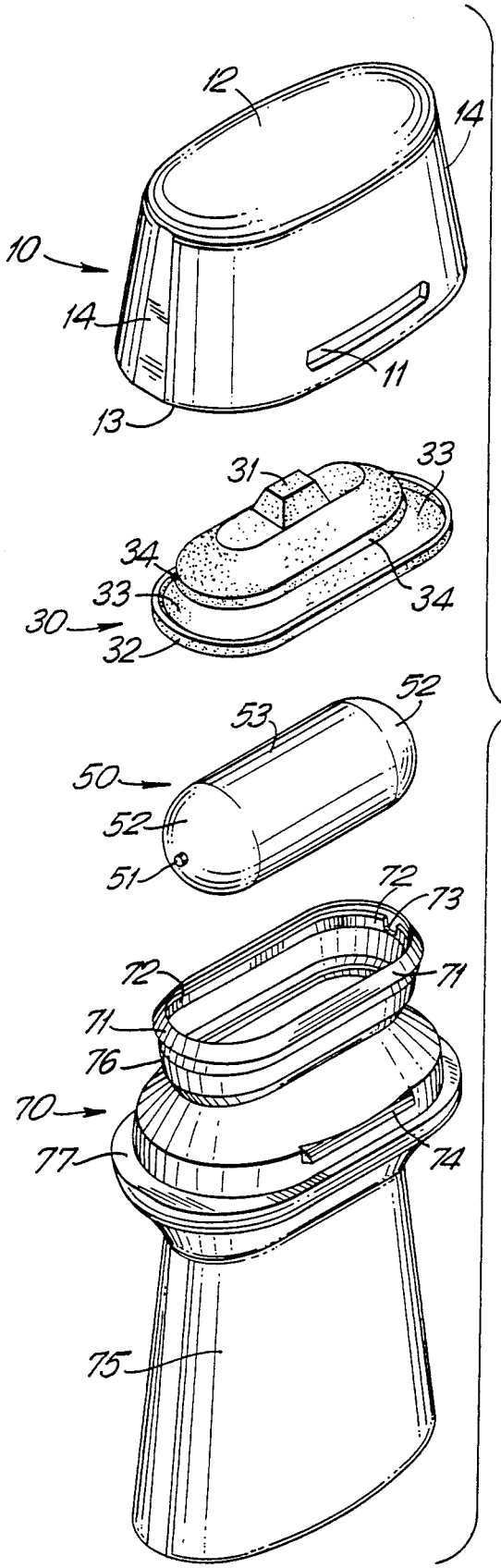
FIG. 1 is an exploded perspective view of the applicator package of the invention.

The applicator package of the invention comprises an elongated roller 50 which is suspended atop a generally hollow container 70 which holds the cosmetic fluid material to be dispensed, such as an antiperspirant composition, deodorant composition, skin or suntan lotion or the like. Cap 10 of the package is designed to accommodate liner 30 which, in turn, is designed to fit over elongated roller 50 and seal the package when the cap is in place on container 70.

More specifically, the applicator package of the invention comprises a container 70, the lower portion of which acts as a reservoir for the fluid material to be dispensed. Container 70 provides substantially unrestricted communication between the reservoir and the lowermost portion of roller 50, in the volume defined within neck area 76. The upper, neck area 76 of container 70 is provided with an internal support wall 72 just below wiping lip 71. Support wall 72 is provided with opposing U-shaped notches 73 therein, into which axle stubs 51 on the longitudinal ends of roller 50 can fit. The uppermost edge of the neck area 76 of container 70 flares upwardly and inwardly to form wiping lip 71. Wiping lip 71 is useful in preventing an excessive amount of fluid material from coating the exposed portion of roller 50.

Figure 2:
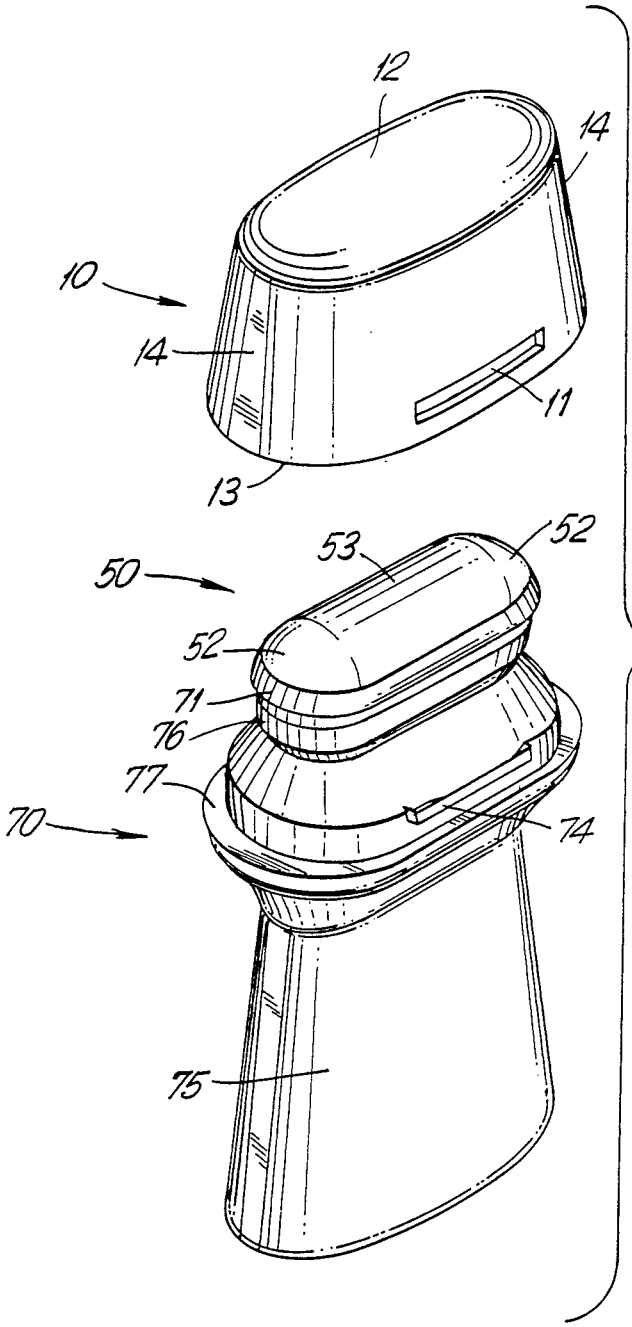
FIG. 2 is a perspective view of the assembled cap and of the assembled product container of the invention.

Roller 50 preferably comprises cylindrical portion 53 and hemispherical end portions 52. Integral axle stubs 51 protrude along the ends of the longitudinal axis of roller 50. Roller 50, axle stubs 51, notches 73 and wiping lip 71 are preferably dimensioned, as will readily be appreciated, such that roller 50 can be forced into position in the open neck area 76 of container 70 (see FIG. 2) after the fluid to be dispensed has been added to the container 70. Furthermore, roller 50 and wiping lip 71 are preferably dimensioned such that wiping lip 71 affords only slight frictional rolling contact with roller 50. Aside from this contact between roller 50 and wiping lip 71 and the contact between axle stubs 51 and notches 73, there preferably is no other contact between roller 50 and container 70.

Cap 10 and resilient liner 30 therein seal the container 70 when in place atop the container 70. Cap 10 comprises top portion 12, opposing sides 14, bottom edge 13 and opposing front and back slots 11. The underside of the center of top portion 12 of cap 10 and abutting liner portion 31 are joined, preferably as by glue 46. Continuous peripheral rib 41 (see FIGS. 3 and 4) depends from the underside of top portion 12 of cap 10.

Figure 3:
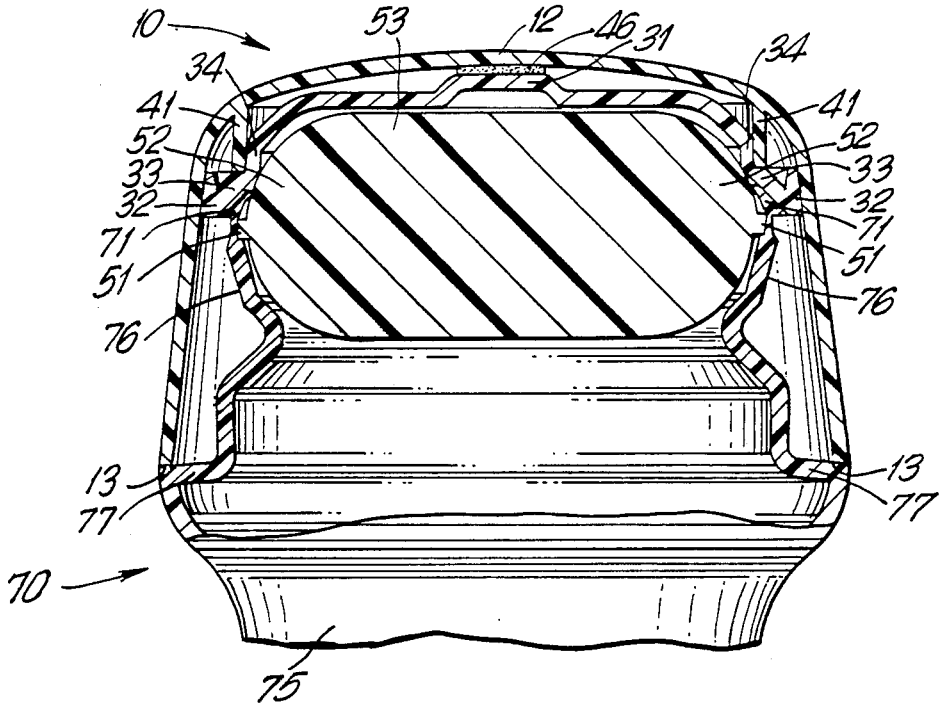
FIG. 3 is a section taken vertically through the longitudinal axis of the upper portion of the closed package of the invention.
Figure 4:
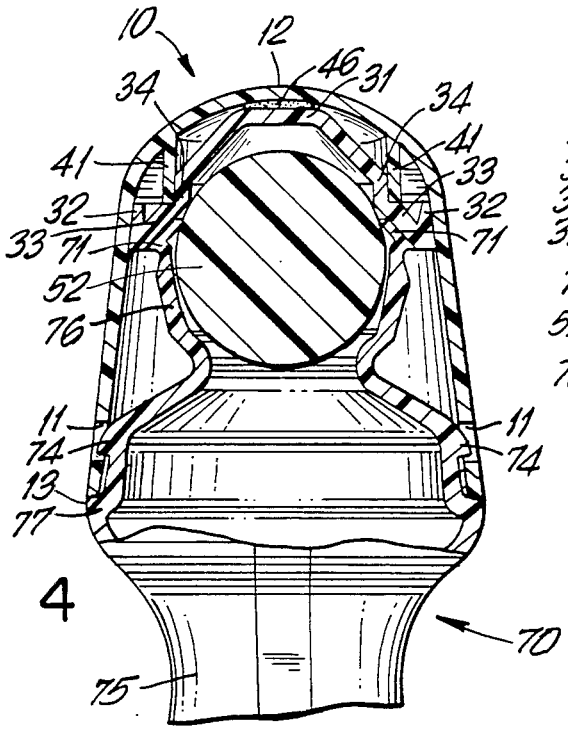
FIG. 4 is a section taken vertically through the center of the upper portion of the closed package of the invention in which the package has been rotated 90° from the view shown in FIG. 3.

As can be seen in FIGS. 3 and 4, when cap 10 is in place on container 70, front and back detent means 74 on container 70 engage opposing front and back slots 11 on cap 10, and bottom edge 13 of cap 10 abuts rim 77 of container 70.

Alternatively, other means of fastening the resilient liner 30 to the underside of cap 10 can be used. The underside of the center of top portion 12 and abutting liner portion 31 can be constructed such that an undercut snap barb protrudes from the top surface of resilient liner 30 and mates with a receiving structure depending from the underside of the center of top portion 12. If desired, such techniques as ultrasonic welding, induction welding, or the like, may be used to join liner 30 and the underside of cap 10. Such methods are well known to those skilled in the art of plastic fabrication. Furthermore, the entire top surface of liner 30 above, say, vertical liner portion 34, can be joined to the entire underside of the top portion 12 of cap 10 by any conventional means without deviating from the scope of the invention.

As can also be seen in FIGS. 3 and 4, when cap 10 is in place on container 70, rib 41 abuts but preferably is not joined to vertical liner portion 34 and the bottom of rib 41 abuts but preferably is not joined to sealing liner portion 33, between liner rim 32 and vertical liner portion 34. The action of rib 41 on sealing liner portion 33 directs the latter against wiping lip 71 and roller 50, thus sealing the package.

Because the package seal is formed in the abovedescribed manner and because the roller 50 contacts the container only as has been previously described, excess product left on the lower portion of roller 50, below wiping lip 71, can drain back into the reservoir portion of container 70 after the package has been closed. Furthermore, the entire roller is sealed to the atmosphere, thus preventing the fluid on roller 50 from drying and reducing the potential for the roller to become fouled due to caking.

The container 70 is preferably an integrally formed, hollow injection blow molded copolymer of propylene and ethylene, though useful alternatives include polypropylene homopolymer and high density polyethylene and any material of suitable strength which is inert to the fluid being dispensed. Preferably the roller 50 is made by injection molding high density polyethylene and centerless grinding of the roller 50 after molding, if necessary, to a smooth finish.

The cap 10 preferably is made by injection molding polypropylene homopolymer and must have sufficient flexibility and deformability in order to be taken on and off the container 70 as will be appreciated by those skilled in the art and as is described below.

The resilient liner 30 is most preferably an injection molded synthetic thermoplastic elastomer comprising a styrene-ethylene/butylene, styrene block copolymer modified with polydimethylsiloxane and commercially available as C-Flex (TM) thermoplastic elastomer 35-A from Concept Polymer Technologies, Inc. of Clearwater, Fla. Preferably the material used to make the liner will have a Durometer measurement of 30–35 Shore A, although materials having Durometer measurements in the range of 20–35 Shore A can be used. U.S. Pat. No. 4,386,179 issued May 31, 1983 generally describes the preparation of synthetic thermoplastic elastomers, such as C-Flex (TM) 35-A, which are suitable for use as the resilient liner 30 of the present invention. The full text of said patent is hereby incorporated herein by reference. Materials with Shore A Durometer measurements greater than about 35 have poor compression set properties and require an unacceptably high degree of force to be applied by the consumer in order to close the package. Currently available materials with Shore A Durometer measurements less than about 20 are undesirable in having unacceptably low tear strength properties. Such materials, also cannot be readily molded and would therefore be much more costly to use. In general, it has been found that materials having elastomeric properties and having a Durometer measurement in the range of 20–35 Shore A are useful as the resilient liner 30 of the invention.

Table A lists typical properties for C-Flex (TM) 35-A, and a less preferred alternative commercially available from Shell, known as Kraton D-2104 and, for comparison purposes, an unacceptable material also commercially available from Shell, known as Kraton G-2705. The Kraton G-2705 material has an unacceptably high Durometer measurement, as shown.

TABLE A

| TYPICAL PROPERTIES | C-Flex 35-A | Kraton G-2705 (Shell) | Kraton D-2104 (Shell) |
|---|---|---|---|
| Durometer (Shore A) | 35 | 55 | 35 |
| Tensile (psi) | 1250 | 1650 | 1175 |
| Elongation (%) | 870 | 800 | 870 |
| Modulus (in psi) | | | |
| at 100% Elongation | 100 | 210 | 180 |
| at 300% Elongation | 180 | 340 | 230 |
| Tear Strength (ppi) | | | |
| Die B un-notched | 300 | no data avail. | 410 |
| Compression Set | | | |
| % at 23° C. | 12 | 17 | 17 |
| % at 70° C. | 64 | 32 | 100 |
| Molded Part Distortion Temp. (under no stress) | >212° F. | >212° F. | <212° F. |
| Ability to Mold Parts With Low Residual Stress | Good | Poor | Extremely Poor |
| Injection Moldability | Excellent | Fair | Fair |
| Tackiness of Molded Parts | Not Tacky | Slightly Tacky | Very Tacky |
| Heat Stability During Molding | Excellent | Excellent | Poor |
| Multi-Cavity Moldability | Good | Fair | Fair to Poor |
| Color | White | Tan | Tan |

It has also been found that ethylene-propylene-diene monomer (EPDM) materials having Durometer measurements within the range of 20–35 Shore A are useful as the resilient liner 30 of the invention. Such EPDM materials are commercially available from a number of fabricators of rubber components, including Vernay Laboratories, Inc. of Yellow Springs, Ohio.

Other materials which can be used in making the resilient liner 30 of the invention include high consistency silicone rubbers having Durometer measurements within the range of 20–35 Shore A. Such materials are commercially available from many different sources, such as Dow Corning of Midland, Mich.

Other elastomeric materials having Durometer measurements within the range of 20–35 Shore A can also be used. For example, other types of synthetic rubbers, natural rubber and other types of synthetic thermoplastic elastomers can be used.

It has been found that the applicator package of the invention is particularly useful for dispensing antiperspirant compositions such as water in silicone oil emulsions which contain astringent antiperspirant compounds.

The package provides a wider application surface than ball roll-ons, with excellent rolling characteristics and sealing means.

Figure 5:
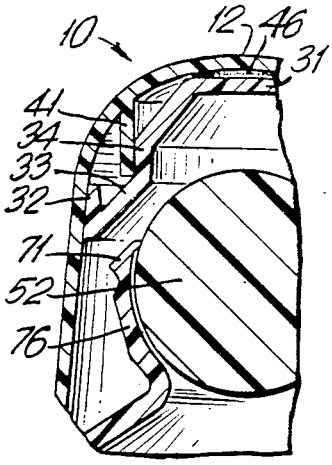
FIG. 5 is a section, similar to the view shown in FIG. 4, but prior to sealing the package and before compression of the resilient liner of the invention.

In order to use the package, the covered applicator is shaken thoroughly, the base 75 of container 70 is grasped with one hand and the sides 14 of resilient cap 10 are squeezed inwardly. This pressure deforms the portions of the cap around opposing front and back slots 11 away from detent means 74, allowing the user to remove the cap. After use, the cap 10 is placed atop container 70 and pushed downwardly, thus causing sealing liner portion 33 to contact wiping lip 71 and roller 50. In order to seal the package by having front and back detent means 74 engage slots 11, additional closing force on cap 10 is necessary. Such additional force drives rib 41 against sealing liner portion 33 thus effecting the seal when detent means 74 engage slots 11. See FIGS. 3, 4 and 5.

What is claimed is:

1. A roll-on applicator package comprising, in combination, a hollow container for storing a fluid to be dispensed, an integral neck area as part of said container having internal opposing notches and an upwardly and inwardly formed wiping lip, a generally cylindrical roller with hemispherical ends and stub axles protruding along the longitudinal axis of the roller, the roller being larger in cross-sectional area than the cross-sectional area defined by the top edge of the wiping lip, the roller being suspended by the stub axles which engage the notches, a removable cap having attached therein, to the underside of the top portion of the cap, a resilient liner, the cap having a downwardly protruding, integral peripheral rib aligned generally with the top edge of the wiping lip, the resilient liner positioned such that when the cap is in place atop the container, a sealing liner portion of the resilient liner is compressed by the peripheral rib causing the resilient liner to bridge the space between the wiping lip and the roller to form a seal, the cap having slots and the container having detent means for fixing the cap atop the container, the detent means and the slots being dimensionally positioned such that the resilient liner must be compressed before the slots can engage the detent means, the resilient liner comprising a synthetic elastomeric material having a Durometer measurement of 20–35 Shore A.

2. The package of claim 1 which contains an antiperspirant or deodorant composition as the fluid to be dispensed.

3. The package of claim 2 wherein the antiperspirant composition comprises a water in silicon oil emulsion.

4. The package of claim 3 wherein the resilient liner comprises a synthetic thermoplastic elastomer.

5. The package of claim 4 wherein the resilient liner comprises a styrene-ethylene/butylene, styrene block copolymer modified with polydimethylsiloxane.

6. The package of claim 3 wherein the resilient liner comprises a synthetic rubber.

7. The package of claim 3 wherein the resilient liner has a Durometer measurement of 30–35 Shore A.

* * * * *